United States Patent [19]

van den Broek

[11] Patent Number: 4,633,595

[45] Date of Patent: Jan. 6, 1987

[54] ROTARY DRYING DRUM

[75] Inventor: Adriaan van den Broek, Zeist, Netherlands

[73] Assignee: VandenBroek International B.V., Netherlands

[21] Appl. No.: 793,325

[22] Filed: Oct. 29, 1985

[30] Foreign Application Priority Data

Nov. 8, 1984 [NL] Netherlands ..... 8403407

[51] Int. Cl.[4] ..... F26B 17/32

[52] U.S. Cl. ..... 34/108; 34/109; 34/135; 34/142

[58] Field of Search ..... 34/108, 109, 135–137, 34/138, 140–142; 432/108, 110

[56] References Cited

U.S. PATENT DOCUMENTS 3,918,168 11/1975 Saeman ..... 34/136

4,290,750 9/1981 Whiteley ..... 432/108

FOREIGN PATENT DOCUMENTS 1962679 6/1971 Fed. Rep. of Germany ..... 432/110

*Primary Examiner*—Larry I. Schwartz

*Attorney, Agent, or Firm*—Burns, Doane, Swecker & Mathis

[57] ABSTRACT

A rotary cylindrical drying drum comprising in axial direction a series of vaned sections, with air and material passages, and in which material to be dried can enter each section via an annular slot disposed along the drum wall and be transported by the vanes in radial direction, and material transporting vanes on either side of each section disposed against the drum wall for axially transporting the material to be dried. According to the invention, each section (7) includes two double-walled, frusto-conical portions whose apices are directed towards one another, the apices of the outer cones (1) being interconnected to form an air and material passage (4), with the edges of the base circles being connected to the drum wall (8) and the inner cones 2 being connected to the outer cones (1) by means of spacers.

11 Claims, 5 Drawing Figures

ROTARY DRYING DRUM

This invention relates to a rotary, cylindrical drying drum comprising in axial direction a series of vaned sections, with air and material passages and in which material to be dried can enter each section through an annular slot provided along the drum wall and be transported by the vanes in radial direction and material transporting vanes on either side of each section, disposed against the drum wall for axially transporting the material to be dried.

Such rotary drying drums have been employed in practice for quite a long time, in particular for drying grass and granular products. Each drum section includes a front plate transverse to the drum wall, said plate leaving open an inlet slot adjacent the drum wall, while a relatively small air passage is provided in the centre of said front plate. At some distance from said front plate there is disposed the rear plate of the section, likewise positioned perpendicular to the drum wall, and whose circumferential edge is connected to the drum wall. In the centre of said rear plate there is provided a relatively large opening for discharging drying air and the material to be dried from the section. Between the rear and the front plate of each section there are arranged vanes which initially, as the drum rotates, carry along the material to be dried, present in the section, and subsequently cause it to whirl downwards in the section so as to bring the product to be dried better into contact with drying air flowing through the drum. The axially moving air stream entrains particles, dried to a greater or lesser extent, through the discharge opening in the rear plate of a section, which entrained product impinges on the front plate of the next section and subsequently falls radially downwards in the drum. Behind each section are material transport vanes, disposed on the inside of the drum wall, which move the material along the drum wall, thereby causing it to pass through the inlet slot into the next section, within which the above process is repeated.

It has been found that the drying process taking place within this prior art drying drum is highly satisfactory, but requires relatively much energy. The energy used by the process consists on the one hand of thermal energy for maintaining the drying process and on the other hand of energy for driving the rotary drum and the main fan for producing a strong air current through the drum. The share of the driving energy in the total energy consumption is large and a substantial part of it is consumed by the main fan. The energy consumed by the fan is proportional to the pressure required for conducting a given air flow through the drum. This pressure depends for a substantial part on the resistance offered by the drying drum, which is mainly caused by the sections placed in the drum.

Another drawback inherent in the prior drum is that the residence time of the material in the successive sections of the drying drum is not controllable.

It is an object of the present invention to provide a drying drum whose energy consumption is substantially reduced and wherein the residence time of the material in the drum is better controllable.

According to the present invention, this object is achieved by providing a drum of the above described type wherein each section includes two double-walled, frusto-conical portions whose apices are directed towards one another, the apices of the outer cones being interconnected to form an air and material passage, with the edges of the base circles being connected to the drum wall, and the inner cones being connected to the outer cones by means of spacers.

Since sections thus designed have a double action, with the material being first conducted radially inwardly and in the second half of the section radially outwardly, the number of sections per drum can be appreciably reduced. The air resistance of the drum is found to be considerably lower, with the thermal efficiency of the drying process being maintained, so that the amount of energy to be supplied to the main fan can be substantially reduced. Because in the second half of each section, wherein the material moves radially outwardly in the direction of the drum wall, a certain quantity of material may fall back into the section, the residence time of the material per section can be extended. The residence time can be further influenced by designing the spacers between the two cones as flat vanes, or by imparting a bent or curved configuration thereto.

A further adjustment of the residence time depending on the material to be dried is obtained by imparting an adjustable pitch angle to the material transport vanes disposed before and behind each section against the drum wall. Said vanes may be adjusted even to such an extent that the direction of movement of the material to be dried is temporarily opposite to the normal direction of travel of the material in the drum.

One embodiment of the drying drum according to the present invention will now be described, by way of example, with reference to the accompanying drawings, in which.

Figure 1:
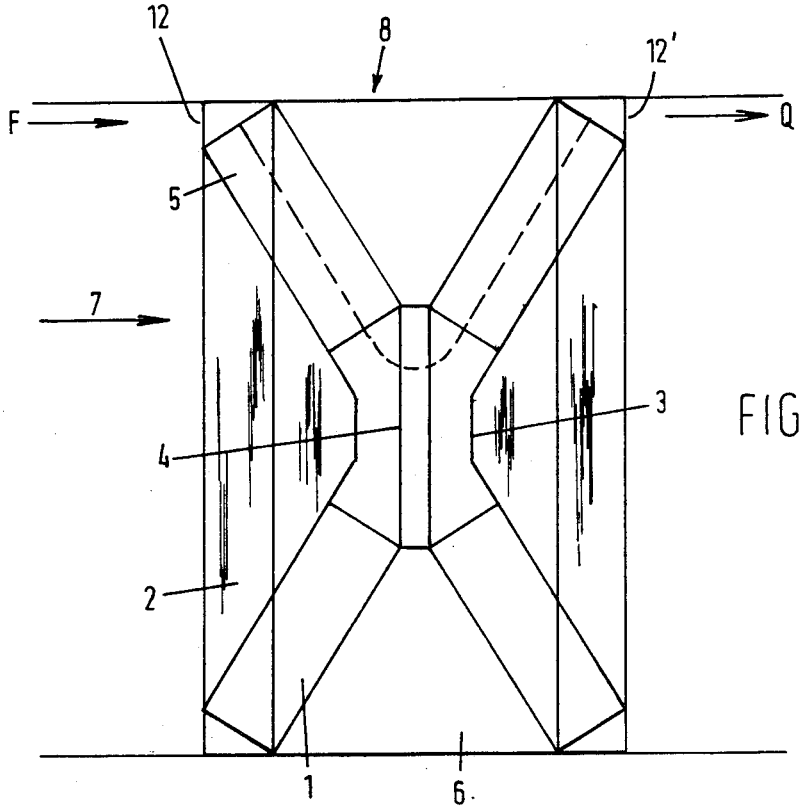
FIG. 1 is a diagrammatic view of a drying section.

The section 7 shown in FIG. 1 is formed by two symmetrically opposite section halves, each including an outer cone 1 and an inner cone 2, the latter having a base circle of smaller diameter than that of the outer cone 1. Both cones 1,2 have a passage 3,4. Passage 3 in the inner cone 2 is destined for the exclusive passage of air, while passage 4 of the outer cone 1 is destined for the passage of a mixture of air and material to be dried. Between cones 1,2 are provided substantially radially extending baffles 5 functioning as vanes.

The edges of the apex circles of the two outer cones 1 are interconnected so that a closed space 6, V-shaped in cross-section is formed between the drum wall 8 and the outer walls of the two outer cones 1.

Figure 2:
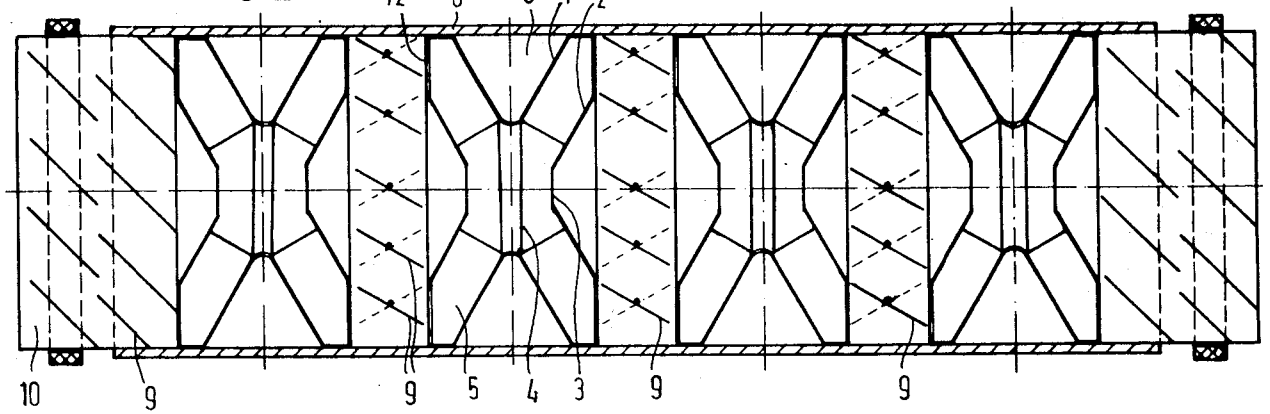
FIG. 2 is a longitudinal sectional view of a drying drum having four sections.
Figure 3:
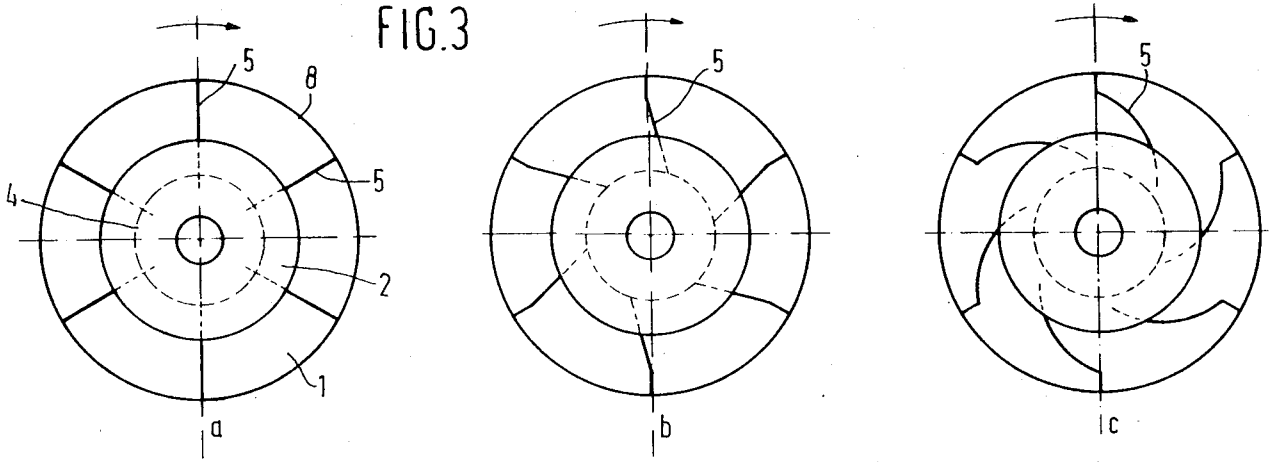
FIGS. 3*a–c* shows axial views of sections with different types of vanes.

The sections 7 are placed in the drum one behind the other and against the drum wall 8, and material transport vanes 9 are disposed before and after each section 7 along the drum wall (FIG. 2). At the drum inlet 10, the material to be dried is supplied and hot air is blown or sucked into the drum. The material to be dried is entrained by the air. Vanes 9 adjacent the drum inlet 10 are placed at an angle of 45° in the direction of transport of the material so as to produce a rapid throughflow of the material to be dried. This rapid throughflow at the drum inlet is desirable, for the drying air has a high temparature at that location. The moisture of air and material will enter the sections mainly along the drum wall, via the annular material passage 12 between the outer and the inner cone. The mixture is conducted along and by the vanes 5, which produce a vortex action in the mixture of air and material and which results in intensive drying. The air-and-material mixture then flows via the two passages 4 into the second half of section 7, leaving it again substantially via the vanes 5 and the annular opening 12'. Depending on the adjustment of the material transport vanes 9, i.e. in the direction of flow of the material or opposite thereto, the material will flow to the next section or flow back to the section 7 just left to a greater or lesser extent. The angle of the material transport vanes 9 to the horizontal determines whether throughflow or backflow will be accelerated or decelerated. The residence time in the sections and in the drum can thus be controlled optimally. In the case of backflow the material is again received in the same manner via passage 12 in the section just left.

The sections 7 are formed with a small air passage 3 in the inner cone 2, while the outer cones have a relatively large inlet opening 4. As a result, the openings 3 of the inner cones 2 practically do not permit the passage of material to be dried, while the material will readily flow from one section half to the next via the large passages 4 in the two outer cones 1.

FIGS. *3a–c* show three possible forms of the vanes present in each section, which also serve as connecting members and spacer between an inner cone 2 and an outer cone 1. In FIG. *3a*, said vanes have a truly radial configuration; in FIG. *3b* the vanes are bent while in FIG. *3c* the vanes have a partly curved configuration, with the radially outer piece extending truly radially. These different vane forms may partly influence the whirling behaviour of the material to be dried, within a section.

I claim:

1. A rotary, cylindrical drying drum comprising in axial direction a series of vaned sections, with air and material passages and in which material to be dried can enter each section via an annular material passage adjacent the drum wall and be transported by the vanes in radial direction and material transporting vanes disposed against the drum wall, on either side of each section for axially transporting the material to be dried, wherein each section includes two double-walled, frusto-conical portions whose apices are directed towards one another, the apices of the outer cones being interconnected to form an air and material passage with edges of the base circles of said outer cones being connected to the drum wall and the inner cones being connected to the outer cones by means of spacers.

2. A drying drum according to claim 1, wherein the spacers include continuous baffles functioning as vanes and connected along the edges to the surfaces of the inner and outer cones.

3. A drying drum according to claim 1, wherein the spacers include continuous baffles functioning as vanes and having a bent or curved configuration in a radial direction.

4. A drying drum according to claim 1, wherein the adjacent apices of the inner cones of each section have a circular air passage, the diameter of which is smaller than the passage in each outer cone.

5. A drying drum according to claim 1, wherein the material transporting vanes disposed before and after each section against the drum wall are provided with means for adjusting the pitch angle.

6. A drying drum according to claim 2, wherein the baffles functioning as vanes have a bent or curved configuration in a radial direction.

7. A drying drum according to claim 2, wherein the adjacent apices of the inner cones of each section have a circular air passage, the diameter of which is smaller than the passage in each outer cone.

8. A drying drum according to claim 3, wherein the adjacent apices of the inner cones of each section have a circular air passage, the diameter of which is smaller than the passage in each outer cone.

9. A drying drum according to claim 2, wherein the material transporting vanes disposed before and after each section against the drum wall are provided with means for adjusting the pitch angle.

10. A drying drum according to claim 3, wherein the material transporting vanes disposed before and after each section against the drum wall are provided with means for adjusting the pitch angle.

11. A drying drum according to claim 4, wherein the material transporting vanes disposed before and after each section against the drum wall are provided with means for adjusting the pitch angle.

* * * * *